United States Patent [19]

Tien et al.

[11] Patent Number: 5,055,745

[45] Date of Patent: Oct. 8, 1991

[54] FLUORESCENT LAMP STABILIZER CIRCUIT DEVICE

[76] Inventors: Ho T. Tien; Shih-Li Tao, both of 5F, No. 1, Alley 61, Lane 114, Sec. 7, Chuang San N. Rd., Taipei, Taiwan

[21] Appl. No.: 598,054

[22] Filed: Oct. 11, 1990

[51] Int. Cl.[5] ..... H05B 37/02

[52] U.S. Cl. ..... 315/226; 315/240; 315/289; 315/DIG. 5; 315/DIG. 7

[58] Field of Search ..... 315/226, 240, 241 R, 315/209 R, 209 CD, 244, 219, DIG. 5, DIG. 7; 323/222

[56] References Cited

U.S. PATENT DOCUMENTS 4,165,475 8/1979 Pegg ..... 315/DIG. 5
4,194,143 3/1980 Farkas ..... 315/240
4,525,650 6/1985 Hicks ..... 315/226

*Primary Examiner*—Eugene R. LaRoche
*Assistant Examiner*—Amir Zarabian
*Attorney, Agent, or Firm*—Morton J. Rosenberg; David I. Klein

[57] ABSTRACT

A fluorescent lamp stabilizer circuit device of the type comprising two transistor switches is provided. The two transistor switches are alternatively switched on/-off so as to control two charging circuits for providing an impulse voltage double that of power supply voltage for initiating operation of a fluorescent lamp to give off light. A resonance circuit is provided to generate a damped oscillation responsive to the impulse voltage to drop output voltage to the fluorescent lamp tube to a rated range immediately after the fluorescent lamp tube has turned on.

1 Claim, 1 Drawing Sheet

FLUORESCENT LAMP STABILIZER CIRCUIT DEVICE

BACKGROUND OF THE INVENTION

The present invention relates to fluorescent lamp stabilizer circuit devices, and more particularly relates to a fluorescent lamp stabilizer circuit device which permits an unserviceable fluorescent lamp tube to keep serving and can eliminate flashing problem while turning on a fluorescent lamp.

In a fluorescent lamp device, a stabilizer is used with a starter to heat the tungsten filaments at the two opposite ends of a fluorescent lamp tube premitting the mercury vapor in the tube to be acted upon by a stream of electrons from the cathode thereof so that the fluorescent substance coated on the inside of the tube gives light. In this structure, the starter may fail after having been used for a certain period of time, causing the tungsten filaments at the two opposite ends of a fluroescent lamp tube to be constantly in a heated or extinguished condition which will result in damage to the fluorescent coating in the lamp. Under this condition, the starter and the fluorescent lamp tube must replaced. Further, a flashing problem may frequently occur when turning on a fluorescent lamp.

SUMMARY OF THE INVENTION

The present invention has been accomplished under the circumstances in view. It is an object of the present invention to provide a fluorescent lamp stabilizer circuit device which can instantaneously turn on a fluorescent lamp tube without causing any flashing problem.

It is another object of the present invention to provide a fluorescent lamp stabilizer circuit device which eliminates the use of a starter and permits a fluorescent lamp tube to keep working when its tungsten filaments are burn out or damaged.

To achieve the above objects, a fluorescent lamp stabilizer circuit device of the present invention comprises two transistor switches which are alternatively switched on/off so as to control two charging circuits to provide and impulse voltage double that of power supply voltage for initiating a fluorescent lamp to give off light. A resonant circuit is provided to generate damped oscillation so as to drop output voltage to the fluorescent lamp tube to a rated range immediately after the fluorescent lamp tube is turned on.

BRIEF DESCRIPTION OF THE DRAWING

The present invention will now be described by way of example with reference to the accompanying drawing of FIG. 1, which is a circuit diagram of the present invention.

Figure 1:
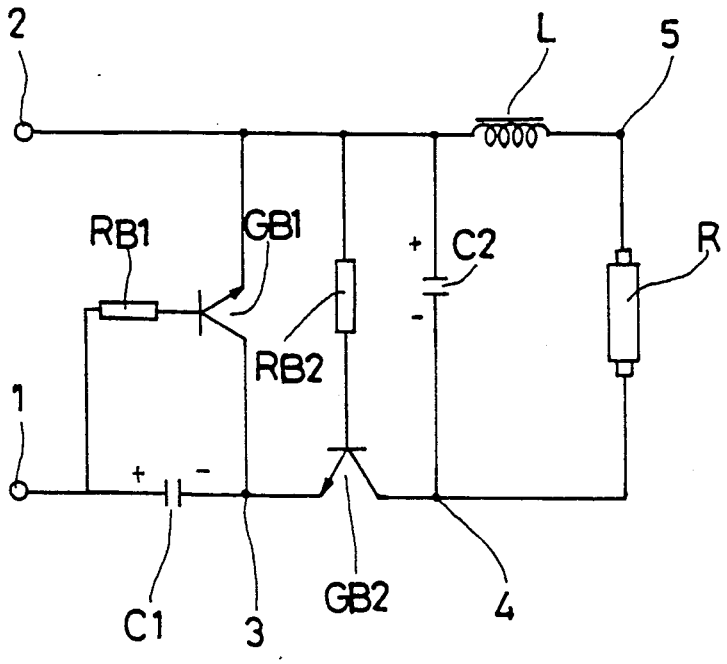

DETAILED DESCRIPTION OF THE PREFERRED EMBODIMENT:

Referring to FIG. 1, a fluorescent lamp stabilizer circuit device of the present invention is generally comprised of transistors GB1, GB2, capacitors C1, C2, Resistors RB1, RB2, inductor L and fluorescent lamp tube R. The whole circuit comprises total five terminals, in which terminals 1 and 2 are for AC power input. The positive end of capacitor C1 is connected to terminal 1. Resistor RB1 is connected between terminal 1 and the base of transistor GB1. The emitter of transistor GB1, the positive end of capacitor C2, one end of inductor L and the positive end of resistor RB2 are respectively connected to terminal 2. The opposite end of resistor RB2 is connected to the base of transistor GB2. The collector of transistor GB2, the negative end of capacitor C2 and one end of fluorescent lamp tube R are respectively connected to terminal 4. The whole circuit structure of the fluorescent lamp stabilizer circuit device forms two charging circuits and a resonance circuit and the operation of which is outlined hereinafter.

When AC power is connected between terminals 1 and 2 and if terminal 1 is positive and terminal 2 is negative, transistor GB1 is turned on immediately and transistor GB2 is cut off, i.e. transistors GB1 and GB2 complement each other. Therefore, terminals 1, 3 and 2 form a charging circuit to charge capacitor C1 to the voltage range V12 at terminals 1 and 2. If terminal 2 is positive and terminal 1 is negative, transistor GB1 is cut off and transistor GB2 is turned on when AC power is connected thereto, and terminals 2, 4 and 3 form a circuit permitting the voltage at capacitor C1 and the voltage V12 from power source to be added together for charging capacitor C2.

Therefore a transient voltage, the value of which is double over the voltage from power source, can be obtained at terminals 2 and 4, which transient voltage is an impulse voltage discharged to inductor L and fluorescent lamp tube R so as to instantly turn on fluorescent lamp R. At the same time, a discharge current is sent through inductor L to cause inductor L to produce an impedance which restrains the current. Because capacitor C2 is connected in parallel with inductor L and fluorescent lamp tube R, a resonance circuit is formed. Capacitor C2 produces damped oscillation while discharging, and therefore the flashing problem is eliminated when fluorescent lamp tube is energized to produce light.

Because the use of the tungsten filament is eliminated by the present invention and a fluorescent lamp tube is started by a transient impulse voltage, before normal voltage is supplied, a fluorescent lamp tube can still be used even if the tungsten filament of the lamp is burned out or damaged.

What is claimed is:

1. A fluorescent lamp stabilizer circuit device coupled to an A.C. voltage source for energizing a fluorescent lamp, comprising:

a first charging circuit coupled to said A.C. voltage source, said first charging circuit including (1) a first capacitor having a first end coupled to a first voltage source terminal, and (2) a first transistor having a collector coupled to a second end of said first capacitor and an emitter coupled to a second voltage source terminal, said first transistor having a base coupled to said first voltage source terminal for turning said first transistor on responsive to said first voltage source terminal being positive with respect to said second voltage source terminal to thereby charge said first capacitor to a first voltage thereacross, said base of said first transistor being coupled to said first voltage source terminal by a resistor coupled in series relation therebetween;

a second charging circuit coupled to said A.C. voltage source, said second charging circuit including (1) a second capacitor having one end coupled to said second voltage source terminal, and (2) a second transistor having a collector coupled to an opposing end of said second capacitor and an emitter coupled to said second end of said first capacitor, said second transistor having a base coupled to said second voltage source terminal for turning on said second transistor responsive to said second voltage source terminal being positive with respect to said first voltage source terminal to thereby charge said second capacitor to a second voltage, said second voltage being a summation of said first voltage across said first capacitor and a voltage across said first and second voltage source terminals, said base of said second transistor being coupled to said second voltage source terminal by a resistor coupled in series relation therebetween; and, an inductor coupled in series relation with said fluorescent lamp, said series coupled inductor and fluorescent lamp being coupled in parallel relation with said second capacitor to form a resonant circuit, whereby said first and second charging circuits operate alternately to provide a voltage sufficient for turning on said fluorescent lamp, said inductor providing means to substantially maintain said fluorescent lamp at a predetermined voltage subsequent to said fluorescent lamp being turned on.

* * * * *